United States Patent [19]

Glanvall

[11] 4,224,014

[45] Sep. 23, 1980

[54] ROTARY COMPRESSOR WITH LIQUID INJECTION

[75] Inventor: Rune V. Glanvall, Norrkoping, Sweden

[73] Assignee: Stal Refrigeration AB, Norrkoping, Sweden

[21] Appl. No.: 950,559

[22] Filed: Oct. 12, 1978

[30] Foreign Application Priority Data

Oct. 13, 1977 [SE] Sweden ..... 7711559

[51] Int. Cl.[3] ..... F04C 18/00; F04C 29/02

[52] U.S. Cl. ..... 418/76; 418/77; 418/79; 418/99

[58] Field of Search ..... 418/76, 77, 82, 91–93, 418/99, 79, 97, 98

[56] References Cited

U.S. PATENT DOCUMENTS 1,781,073 11/1930 Nielsen ..... 418/99

*Primary Examiner*—John J. Vrablik

*Attorney, Agent, or Firm*—Cyrus S. Hapgood

[57] ABSTRACT

A rotor is journalled in a housing having gas inlet ports and outlet ports for compressed gas, the gas being compressed in working chambers formed between the rotor, an inner surface of the housing and vanes which periodically move inward and outward in slots in the rotor during its rotation and while sliding against said inner surface of the housing. Oil or other liquid is injected into the working chambers through grooves in at least one internal wall of the housing, the grooves being positioned to communicate with the working chambers through small recesses, located in edge portions of the rotor, during at least parts of the periods starting when a vane immediately trailing one of said recesses has just passed a said inlet port, thus blocking the connection between said last inlet port and the corresponding working chamber immediately preceding said vane, and ending when the pressure in said corresponding working chamber equals the liquid injection pressure.

3 Claims, 2 Drawing Figures

ROTARY COMPRESSOR WITH LIQUID INJECTION

Figure 1:
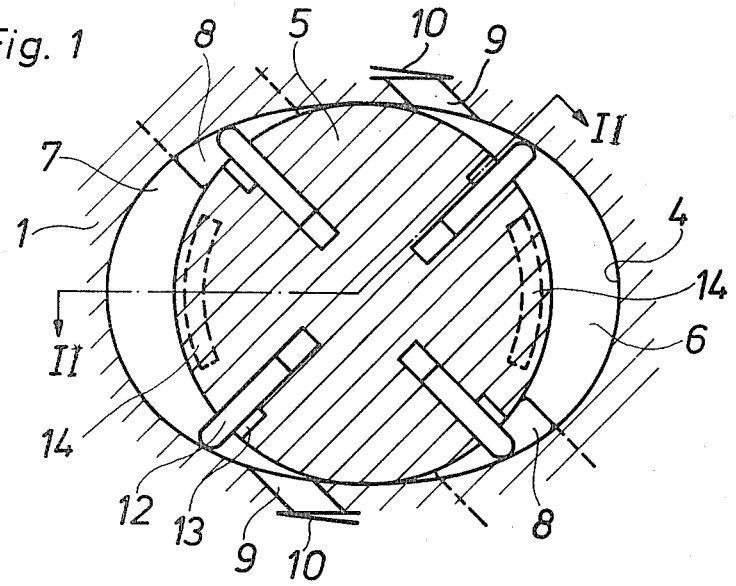

The present invention relates to a rotary compressor of the sliding vane type comprising a housing provided with inlet ports for a gas to be compressed and outlet ports for compressed gas, and a cylindrical rotor journalled in the housing and provided with vanes slidable in slots in the rotor, the vanes being arranged to sealingly slide against the inside surface of the housing to form working spaces between the rotor, the inside surface of the housing and the vanes.

More specifically, the invention relates to new details for controlling liquid injection in a compressor of the type mentioned above. In this context, the term liquid injection primarily refers to injection of oil for lubrication, sealing and possibly also cooling, but the invention can also be applied for injection of other liquids such as the injection of refrigerant into a cooling compressor to cool the same. The description below refers particularly to a cooling compressor in which oil is injected for said purpose. The oil which, in an oil circulation system, is introduced into and discharged from the working space of a cooling compressor contains a considerable amount of dissolved refrigerant, which is partially vaporized when the oil enters the working space of the compressor during a period when low pressure prevails in said space. It is therefore desirable to arrange the oil injection so that it does not occur during those periods when the refrigerant which vaporizes from the oil will replace and thereby reduce the intake of uncompressed refrigerant gas, thus reducing the volumetric efficiency as well as the total efficiency of the compressor. To avoid back flow in the oil circulation system, it is also important that the injection conduits do not open against a compressor working space pressure which is higher than the oil injection pressure.

A usual way to arrange oil injection in a rotary sliding vane compressor is to arrange injection conduits through the cylindrical housing wall directly into the working space of the compressor. In certain embodiments with a low number of rotor vanes, however, it is not possible to avoid direct connection between the injection conduits and the inlet ports and the outlet ports of the compressor, with the unsatisfactory result mentioned above (reduced efficiency and the risk of back flow in the oil circulation system).

According to a copending patent application Ser. No. 950,558 filed Oct. 12, 1978, relating to a rotary compressor of the kind previously mentioned, I have solved the above-mentioned problem with liquid injection by providing the rotor with oil injection conduits leading to the working spaces of the compressor, and valve members designed to operate in response to the movement of the vanes and to open and close the connections between said oil injection conduits and the working spaces during the desired periods. Similarly, according to the present invention, conduits have been provided in the rotor for the oil injection. In this context, consideration is to be given to the problem associated with the so-called detrimental volume of the rotor conduits which reduces the efficiency of the compressor. According to said copending patent application, this problem is solved by arranging valve members to close the injection conduits at points near the end of the conduits at the rotor periphery or by filling up mechanically the remaining detrimental volume in the conduits during the critical periods when the working spaces of the compressor are connected with the gas inlet ports and outlet ports.

According to the present invention, a rotary compressor of the kind previously mentioned is characterized in that grooves for liquid injection are arranged in at least one of the housing end walls and that these grooves communicate with the working spaces, through small recesses made in the edges of the rotor, during at least parts of the periods starting when a vane immediately trailing one of said recesses, as seen in the direction of rotation, has just passed an inlet port and thus shut off the connection between the same and the corresponding working space immediately preceding the vane, and ending when the pressure in said corresponding working space equals the liquid injection pressure.

In a rotary compressor according to the invention, the desired intermittent oil injection is achieved in a simple and efficient way without the use of special valve members, in that oil injection grooves are provided in one or both of the housing end walls inside the rotor periphery but close to the same so that they will be opened to the working spaces through the recesses in one or both of the rotor edges during the periods when oil injection can occur without efficiency losses or risk of back flow. Thus, the problem associated with the detrimental volume formed by the oil conduits in the rotor is solved by designing said conduits to consist of the small recesses made in the rotor edge, the detrimental volume of said recesses being of negligible size. According to the invention, the outlet ports for the compressed gas are located in the peripheral wall of the housing (rather than in an end wall thereof) and communicate with the working chambers independently of the edge recesses in the rotor; and it is because of this feature that the edge recesses can be of said negligible size.

Figure 2:
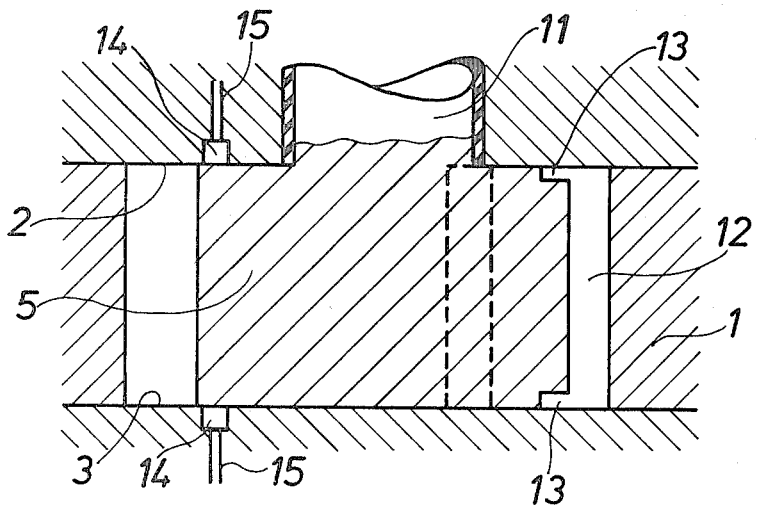

The invention will be described more in detail below by means of an embodiment given as an example and with reference to the attached drawing, in which FIG. 1 shows a cross section of a rotary compressor having double working spaces and four vanes, and FIG. 2 shows a longitudinal section of the compressor taken on line I—I in FIG. 1.

The rotary compressor shown in FIGS. 1 and 2 comprises a housing 1 which is internally limited by two plane, parallel end walls 2 and 3 and by a cylindrical peripheral wall 4 having an elliptic-like cross section. In the housing 1 a cylindrical rotor 5 is journalled, which divides the internal space of the housing in two identical working chambers 6 and 7. Each working chamber is provided with an inlet port 8 arranged in the end wall 3 and an outlet port 9 arranged in the peripheral wall 4. In this embodiment, the outlet port 9 is provided with an outlet valve 10.

The rotor 5 is connected with a drive shaft 11 and is provided with vanes 12 which are slidingly located in axial slots of the rotor to sealingly slide against the walls of the working chambers 6 and 7. The rotor is also provided at both ends with small recesses 13, which are cut out in both edges of the rotor in front of each vane, as seen in the direction of rotation. In the end walls 2 and 3 are oil injection grooves 14, which are located close to but radially inside the periphery of the rotor and opened to the working chambers 6 and 7 through the recesses 13 for oil injection during the desired periods. Conduits 15 in the housing serve to connect the grooves 14 with the rest of the oil circulation system, the design of which is unessential to the present invention.

From the foregoing example, it will be apparent that the oil grooves 14 in the compressor housing end walls can easily be designed with regard to the number of vanes, the location of the inlet ports and outlet ports in the housing and the location of the recesses 13 in the rotor edges so that the connection between said grooves 14 and the working chambers through the recesses 13 will not occur until a vane trailing the corresponding recess 13, as seen in the direction of rotation, shuts off the corresponding working chamber from the corresponding inlet port 8 and so that said connection is shut off when the pressure reached in the working chamber is sufficient to create a risk of back flow in the oil circulation system. Likewise, it will be apparent that the invention can be applied to compressors of the kind exhibiting arbitrary choice of parameters such as the number of working spaces, the number of vanes, the type of inlet and outlet devices and the location of the same in the compressor housing.

I claim:

1. A rotary compressor of the sliding vane type comprising a housing having an inner surface and provided with inlet ports for a gas to be compressed and with outlet ports for compressed gas, a cylindrical rotor journalled in the housing for rotation about an axis and provided with end walls, the rotor having slots opening through the peripheral surface of the rotor and also having edges in which small recesses are cut, vanes movable in said slots generally radially of the rotor and adapted to slide sealingly against said inner surface of the housing, the vanes being movable periodically inward and outward in the slots during rotation of the rotor, working chambers being formed between the rotor, said inner surface of the housing and the vanes, said housing inner surface including internal end walls opposing said end walls of the rotor and also including a peripheral wall surrounding the rotor, there being grooves for liquid injection in at least one of said housing end walls and positioned to communicate with the working chambers through said edge recesses in the rotor during at least parts of the periods starting when a vane immediately trailing one of said recesses, as seen in the direction of rotation, has just passed a said inlet port, thereby shutting off the connection between said last inlet port and the corresponding working chamber immediately preceding said vane, and ending when the pressure in said corresponding working chamber equals the liquid injection pressure, said outlet ports being located in said peripheral wall of the housing and positioned to communicate with the working chambers independently of said edge recesses during said rotation of the rotor, said recesses being sufficiently small to avoid forming any substantial detrimental volume when passing the inlet and outlet ports in direct communication therewith.

2. The compressor of claim 1, in which each inlet port is located in a said end wall of the housing.

3. The compressor of claim 1, in which each of said liquid injection grooves is arcuate and curves partly around said axis.

* * * * *